US005972547A

United States Patent [19]

Yaguchi et al.

[11] Patent Number: 5,972,547

[45] Date of Patent: Oct. 26, 1999

[54] ELECTROSTATIC CHARGE IMAGE DEVELOPING TONER, ELECTROSTATIC CHARGE IMAGE DEVELOPER, AND IMAGE FORMING METHOD USING THIS DEVELOPER

[75] Inventors: Hidekazu Yaguchi; Michio Take; Masaki Hashimoto; Hiroshi Nakazawa; Jun Igarashi; Masanori Ichimura, all of Minami-Ashigara, Japan

[73] Assignee: Fuji Xerox Co., Ltd., Tokyo, Japan

[21] Appl. No.: 09/129,999

[22] Filed: Aug. 6, 1998

[30] Foreign Application Priority Data

Aug. 12, 1997 [JP] Japan ..... 9-217738

[51] Int. Cl.[6] ..... G03G 9/097; G03G 9/09; G03G 13/01

[52] U.S. Cl. ..... 430/45; 430/106; 430/110; 430/111

[58] Field of Search ..... 430/45, 106, 110, 430/111, 120

[56] References Cited

U.S. PATENT DOCUMENTS

| | | | |
|---|---|---|---|
| 5,298,356 | 3/1994 | Tyagi et al. | 430/110 |
| 5,364,723 | 11/1994 | Georges et al. | 430/110 |
| 5,486,445 | 1/1996 | Van Dusen et al. | 430/110 |

FOREIGN PATENT DOCUMENTS

| | | |
|---|---|---|
| 49-118729 | 11/1974 | Japan . |
| 49-118945 | 11/1974 | Japan . |
| 54-34033 | 3/1979 | Japan . |
| A-4-257868 | 9/1992 | Japan . |
| A-6-184249 | 7/1994 | Japan . |
| A-7-199534 | 8/1995 | Japan . |
| A-8-278658 | 10/1996 | Japan . |
| A-8-333425 | 12/1996 | Japan . |

*Primary Examiner*—Roland Martin
*Attorney, Agent, or Firm*—Oliff & Berridge, PLC

[57] ABSTRACT

There is provided an electrostatic charge image developing toner comprising at least a binder resin, a coloring agent, and an aromatic hydrocarbon copolymer resin, wherein, in a toner particle, the percentage of dispersed aromatic hydrocarbon copolymer resin particles having a longitudinal diameter of 2.0 $\mu$m or greater among the total number of dispersed aromatic hydrocarbon copolymer is 10% or less. The toner has superior effects of excellent grindability and not melting and adhering to apparatuses, without there being any adverse effect on basic abilities of the toner such as electrostatic charge property, fixing property, color, and the like.

20 Claims, No Drawings

ELECTROSTATIC CHARGE IMAGE DEVELOPING TONER, ELECTROSTATIC CHARGE IMAGE DEVELOPER, AND IMAGE FORMING METHOD USING THIS DEVELOPER

FIELD OF INVENTION

The present invention relates to an electrostatic charge image developing toner used for electrophotography methods, electrostatic recording methods, electrostatic charge printing methods and the like.

DESCRIPTION OF THE RELATED ART

An electrostatic charge image developing toner is produced, in general, through the following process; in which a bonding resin, a coloring agent and various additives which are optionally added are mixed, a process in which the mixture is melted and kneaded using a kneading machine, a process in which the kneaded material is cooled before being coarsely ground to a particle size of several millimeters, a process in which the coarsely ground material is ground even more finely to a particle size of several micrometers by utilizing impacts such as collision, a process in which the finely ground material is classified, a process in which external additives such as a fluidizing agent, a transferring aid and the like are added and mixed, and a process in which the coarse materials produced in the mixing process and the like are sieved and removed. Recently, a toner with a smaller particle size and aimed at obtaining high image quality has been developed, and polyester-based resins have increasingly been used as bonding resins for securing lower temperature fixing properties. Due to such a background, the finely grinding process which had originally been a rate-controlling process has required even more time, leading to a decrease in productivity. Therefore, grinding machines have been widely improved to enhance grinding ability. While productivity has improved, because of the tendency towards increased production costs due to enlarged grinding machines, high energy consumption and the like, improvements in grinding property must be considered from the standpoint of materials.

To solve these problems, methods such as changing the constituent monomers of a bonding resin, and lowering the softening point and the glass transition point, which improve the grindability of a toner, have been considered. However, the toner tends to adhere to the inside of the grinding machine or the classifying machine, as well as the inside of the tubes connecting them, and in extreme cases, the toner melts and adheres, influencing production conditions. Further, the electrostatic property and fixing property of the toner are rather influenced; there are many drawbacks to obtaining excellent grindability. Another method that has been considered is the addition of material to improve grindability. For example, Japanese Patent Application Laid-Open (JP-A) No. 4-257868 suggests a technology for achieving both grindability and fixing property by using an aromatic petroleum resin, and JP-A No. 8-278658 suggests a technology for achieving both grinding property and thermal retention property by using a hydrogenated petroleum resin. Though these technologies can improve grindability, the problem of impairing the electrostatic property of the toner occurs.

SUMMARY OF THE INVENTION

The present invention has been made in view of the problems described above, and an object thereof is to provide an electrostatic charge image developing toner which does not adversely affect basic properties of a toner such as electrostatic property, fixing property, color and the like, and which in the finely grinding process manifests excellent grindability without melting and adhering to apparatuses.

The above-described problem can be solved by using a grinding aid which does not change the rheology of a binder resin. That is, the present invention provides an electrostatic charge image developing toner comprising at least a binder resin, a coloring agent, and an aromatic hydrocarbon copolymer resin, wherein the percentage in a toner particle of dispersed aromatic hydrocarbon copolymer resin particles having a longitudinal diameter of 2.0 $\mu$m or greater is 10% or less.

Particularly, the present invention provides the above-described electrostatic charge image developing toner comprising a copolymer resin containing at least a styrene-based monomer represented by the following general formula (I) (wherein, $R^1$, $R^2$, $R^3$ and $R^4$ may be the same or different and represent a hydrogen atom or an alkyl group having 4 or fewer carbon atoms) and an indene-based monomer represented by the following general formula (II) (wherein, $R^5$, $R^6$ and $R^7$ may be the same or different and represent a hydrogen atom or an alkyl group having 6 or fewer carbon atoms).

(I)

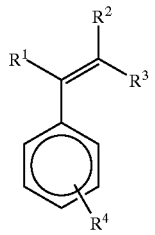

(II)

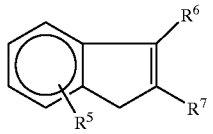

Further, the present invention provides the above-described electrostatic charge image developing toner using a copolymer resin in which the ratio by mol of the styrene-based monomer (I) to the indene-based monomer (II) is from 40/60 to 80/20 and the softening point Tm thereof is from 100 to 170° C.

The present invention also provides an electrostatic charge image developing toner using a binder resin, a copolymer resin containing at least a styrene-based monomer and an indene-based monomer, and a pigment selected from the group consisting of C. I. Pigment Red 57:1 and/or C. I. Pigment Red 122, C. I. Pigment Yellow 180, C. I. Pigment Blue 15:3 and carbon black as a coloring agent.

Further, the present invention provides an image forming method in which a black-white or full-color image is formed by using the above-described electrostatic charge image developing toner as an electrostatic charge image developer.

DETAILED DESCRIPTION OF THE INVENTION

The present invention will be described in detail below.

The copolymer resin used in the present invention is a copolymer which preferably contains a styrene-based monomer represented by the following general formula (I) and an indene-based monomer represented by the following general formula (II), and in which preferably the ratio by mol of the monomer (I) to the monomer (II) is from 40/60 to 80/20 and the softening point Tm thereof is from 100 to 170° C. The longitudinal diameter of a dispersed particle of the copolymer resin in a binder resin is preferably less than 2.0 μm. If, in a toner particle, the percentage of dispersed aromatic hydrocarbon copolymer resin particles having a longitudinal diameter being equal to or exceeding 2.0 μm is 10% or greater among the total number of dispersed aromatic hydrocarbon copolymer, transparency and powdery characteristics of the toner are diminished and uneven coloring may occur.

(I)

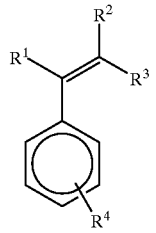

(II)

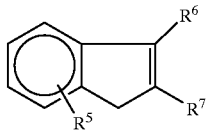

In the general formula (I) representing a styrene-based monomer, $R^1$, $R^2$, $R^3$ and $R^4$ may be the same or different and represent a hydrogen atom or an alkyl group having 4 or fewer carbon atoms. Examples of the alkyl group having 4 or fewer carbon atoms include a methyl group, ethyl group, n-propyl group, n-butyl group and the like. Specific examples of the styrene-based monomer represented by the general formula (I) include styrene, vinyltoluene, α-methylstyrene, isopropenyltouene and the like. Of these styrene-based monomers, isopropenyltoluene is particularly preferably used.

In the general formula (II) representing the indene-based monomer, $R^5$, $R^6$ and $R^7$ may be the same or different and represent a hydrogen atom or an alkyl group having 6 or fewer carbon atoms. Examples of the alkyl group having 6 or fewer carbon atoms include a methyl group, ethyl group, n-propyl group, n-butyl group, n-pentyl group, n-hexyl group and the like. Specific examples of the indene-based monomer represented by the general formula (II) include indene, methylindene, ethylindene and the like. Of these indene-based monomers, indene is particularly preferably used.

The copolymer resin used in the present invention can contain, in a range that is not harmful to the object of the present invention, monomers other than the styrene-based monomer and the indene-based monomer represented by the general formulae (I) and (II) respectively. Examples of monomers are monomers obtained from fraction containing unsaturated hydrocarbons having 4 to 5 carbon atoms by-produced in petroleum refining and cracking. The content of the other monomer differs depending on the kind of the monomer it is, but the monomer can be used without particularly changing the nature of the copolymer resin, provided the content thereof is in the range from about 0 to 10% by mol of the copolymer resin.

In the production of the copolymer resin of the present invention, it is more preferable to use a pure monomer of high purity since then the coloring of the resin and odor generation during heating can be suppressed to a low level. The production of the copolymer resin used in the present invention is described in detail in JP-A No. 6-184249, and the following are similar examples thereof; a method for producing an aliphatic hydrocarbon-aromatic hydrocarbon copolymerized petroleum resin in JP-A No. 8-333425, and methods for producing an aromatic hydrocarbon homopolymerized petroleum resin in JP-A Nos. 49-118729 and 49-118945, and Japanese Patent Application Publication (JP-B) No. 54-34033.

The copolymer resin used in the present invention has characteristics such as high softening point when the molecular weight thereof is low (low melt viscosity) and excellent balance in compatibility with various resins, elastomer and wax. This copolymer resin can achieve both preservability under heat and finely grinding property by being melt-blended with a bonding resin, and does not exert an influence on the electrostatic charge property of the toner.

The amount of the copolymer resin used in the present invention is from 1 to 20 parts by weight based on 100 parts by weight of a toner bonding resin. An amount from 3 to 15 parts by weight is more preferable. When the amount is 1 part by weight or less, there are no results in terms of grindability, and when it is 20 parts by weight or more, the toner tends to be excessively ground and there is the fear that the particle size of the toner could change greatly in a developing machine.

In general, a copolymer resin is often more expensive than a bonding resin; therefore, from the perspective of cost as well, it is preferable that the used amount of the copolymer resin is as low as possible.

The softening point as measured by a ring and ball method of the aromatic hydrocarbon copolymer resin used in the present invention is preferably from 100 to 170° C., and even more preferably from 130 to 160 ° C. When the softening point is 170° C. or more, there is the fear that the fixing property at low temperatures may deteriorate.

Conventionally known resins can be used as the binder resin used in the present invention. Examples thereof include a polyester resin, styrene resin, styrene-(meth) acrylic resin, styrene-butadiene resin, epoxy resin, polyurethane resin and the like. Polyester resins are preferable from the standpoint of the fixing property at low temperatures. The glass transition point Tg of the binder resin is preferably in the range from 60 to 75° C. When Tg is lower than 60° C., the preservation stability of the toner tends to deteriorate, and when Tg is over 75° C., the fixing property at low temperatures tends to become difficult.

As the binder resin used in the present invention, a polyester resin is preferred. More specifically, a polyester resin having a number average molecular weight Mn of 2500 to 5500, and a weight average molecular weight Mw of 7000 to 30000, a softening point Tm of 95 to 120° C., a glass transition point of 60 to 75° C. and containing no chloroform-insoluble component is preferred. Examples of such a polyester resin are resins produced by a polyhydric alcohol component and a polyvalent carboxylic acid (such polyester resins are also used for preparing the high concentration pigments described later).

Examples of the polyhydric alcohol component include ethylene glycol, propylene glycol, 1,4-butanediol, 2,3-butanediol, diethylene glycol, triethylene glycol, 1,5-pentanediol, 1,6-hexanediol, neopentylene glycol, 1,4-cyclohexane dimethanol, dipropylene glycol, polyethylene glycol, polypropylene glycol, bisphenol A, hydrogenated bisphenol A, polyoxyethylene (2,2)-bis(4-hydroxyphenyl) propane, polyoxypropylene(2,2)-bis(4-hydroxyphenyl) propane and the like, as dihydric alcohol components. As trihydric or higher alcohol components, glycerin, sorbitol, 1,4-sorbitan, trimethylolpropane and the like can be used.

As divalent carboxylic acid components which are condensed with the above-described polyhydric hydroxy components, maleic acid, maleic anhydride, fumaric acid, phthalic acid, terephthalic acid, isophthalic acid, malonic acid, succinic acid, glutaric acid, dodecenylsuccinic acid, n-octylsuccinic acid and lower alkylesters of these acids, for example, can be used.

In the present invention, the polyester resin used as the binder resin preferably contains as constituent components polyoxyethylene(2,2)-bis(4-hydroxyphenyl)propane or polyoxypropylene(2,2)-bis(4-hydroxyphenyl)propane as the dihydric alcohol compound component, and a trihydric or higher alcohol component and a divalent carboxylic acid.

The polyester resin used in the present invention preferably does not contain a chloroform-insoluble component. In producing such a polyester resin, it is necessary to adjust production so that the molecular weight of the produced polyester resin does not increase, through methods such as terminating the reaction when the molecular weight thereof reaches a suitable range, and the like.

In the present invention, the polyester resin has a number average molecular weight Mn preferably in the range from 2500 to 5500, and more preferably in the range from 2500 to 4500. When the number average molecular weight is over 5500, grindability deteriorates markedly, and consequently productivity is impaired. On the other hand, when the number average molecular weight is less than 2500, toner image strength weakens and consequently the toner tends to be excessively ground (the toner is ground in the developing machine of the copying machine). The weight average molecular weight Mw of the polyester resin is preferably in the range from 7000 to 30000. When the weight average molecular weight is over 30000, grindability deteriorates, and consequently productivity is impaired. On the other hand, when the weight average molecular weight is less than 7000, the molecule coagulating force of the polyester weakens and consequently the releasing property of the toner deteriorates.

Further, the polyester resin used in the present invention preferably has a softening point Tm in the range from 95 to 120° C. and preferably has a glass transition point Tg in the range from 60 to 75° C. When Tm is lower than 95° C., a non-offset temperature range can not be fully secured, and on the other hand, when Tm is over 120° C., fixing at low temperatures becomes difficult. When Tg is lower than 60° C., the preservation stability of a toner deteriorates, and coagulation in the developing machine becomes problematic under conditions such as high temperatures and high humidity. On the other hand, when Tg is over 75° C., fixing at low temperatures becomes difficult.

Examples of the coloring agent used in the present invention include carbon black, oil black, graphite, nigrosine dye, aniline blue, chrome yellow, Ultra Marine Blue, Dupont Oil Red, quinoline yellow, methylene blue chloride, phthlocyanine blue, Malachite Green Oxalate, lamp black, Rose Bengal, C. I. Pigment Red 57:1, C. I. Pigment Red 122, C. I. Pigment Red 149, C. I. Pigment Red 81:1, C. I. Pigment Yellow 12, C. I. Pigment Yellow 180, C. I. Pigment Yellow 17, C. I. Pigment Blue 15:1, C. I. Pigment Blue 15:3 and the like. Among these, including C. I. Pigment Red 57:1 and/or C. I. Pigment Red 122 as a magenta toner, C. I. Pigment Yellow 180 as a yellow toner, and C. I. Pigment Blue 15:3 as a cyan toner are preferable. Through combinations of these coloring agent pigments, more preferable color reproducing properties and image stabilizing properties can be realized.

From the standpoint of uniform dispersing property and color reproducing property of the pigment, preparing a flushing treatment product or high concentration pigment pellets as described below and using it as a coloring agent is preferable to adding the coloring agent pigments as is into the bonding resin.

In comparison to a case in which a pigment which is a coloring agent is compounded as is into a binder resin, a coloring agent containing a pigment in high concentration in a resin matrix can provide a toner having higher pigment dispersing property and uniformity when producing the toner, since the pigment is uniformly contained in a high concentration in the same resin as the binder resin constituting the toner. Therefore, using the high concentration pigment coloring agent in producing the toner of the present invention is desirable. Examples of the high concentration pigment coloring agents are a high concentration pigment pellets, flushing compositions, and the like. Among these coloring agents, a flushing treatment composition is preferably used from the standpoint of simplicity of production and uniformity of pigment.

For producing high concentration pigment pellets suitable for use in the toner composition of the present invention, a pigment exemplified as a coloring agent is added in a dry condition to the above-described polyester resin or the like, which is used as a bonding resin, and the mixture is heat-melted and mixed with a kneading machine such as a kneader. During this procedure, it is preferable that the pigment is uniformly dispersed in the resin by applying a high shearing force to the mixture or passing the mixture between a plurality of rolls, using a thermal type twin roll, triple roll or the like. While the pigment content in the resin in this operation is not particularly restricted, 20 to 60% by weight is preferable.

In preparing a flushing treatment product containing a pigment in high concentration, for example in the case of a magenta toner, a pigment for a magenta toner such as an aqueous paste of the above-described C. I. Pigment Red 57:1 pigment and/or an aqueous paste of the above-described C. I. Pigment Red 122 pigment, for example, and the above-described polyester resin are kneaded under normal pressure at a temperature not lower than the softening point of the resin and subjected to flushing treatment to obtain a flushing treatment product in which water is substituted. In the case of a yellow toner, a pigment for a yellow toner, and in the case of a cyan toner, a pigment for a cyan toner, are likewise added to obtain a flushing treatment product.

The coloring agent used in the black toner of the present invention is a known coloring agent such as carbon black, and does not particularly require flushing.

In the flushing treatment product of the coloring agent used in the toner composition of the present invention, a pigment is uniformly dispersed in a high proportion in a resin matrix. In this case, the pigment content in the resin is not particularly restricted, but 20 to 60% by weight is preferable.

In the present invention, the coloring agent content of the magenta, cyan, yellow and black toners is in the range from 0.5 to 15% by weight, with 1 to 10% by weight based on 100 parts by weight of a binder resin preferred. When this coloring agent content is less than 0.5% by weight, coloring force weakens and a sufficient effect can not be produced. When the coloring agent content is over 15% by weight, transparency deteriorates.

In the present invention, a releasing agent may be added to the toner to complete offset resistance. The electrostatic control of the toner may be effected by the binder resin or the coloring agent themselves, however, it may also be effected by using at the same time, as needed, an electrostatic controlling agent which does not cause problems with respect to the color reproducing property.

Further, for the purpose of improving the durability, flowability or cleaning property of a toner, there can be added as needed, as external additives, inorganic fine powders such as silica, titanium oxide, and aluminum oxide; organic fine particles such as metal salts and fatty acids or derivatives thereof; and resin fine particles such as fluorine-based resin fine particles, polyethylene fine particles, acrylic resin fine particles and the like.

The toner of the present invention can be produced by melting and kneading, grinding, and classifying a binder resin, the above-described flushing coloring material or high concentration pigment pellets as a coloring agent, and various additives by using a Banbury mixer, kneader coater, CM mixer, extruder or the like. The average particle size of the resulting toner is preferably from 3 to 9 $\mu$m.

The toner of the present invention is used in a one-component developer or two-component developer. When used in a two-component developer, the toner is mixed with a carrier for use. Known carriers such as ferrite, iron oxide powder, nickel or magnetic metal powder carriers, coated carriers obtained by coating these with a resin, magnetic powder dispersed type carriers, and the like can be used as the carrier.

In the present invention, a full-color image can be obtained by a usual method by using the above-described cyan, magenta and yellow color toners and optionally a black toner. Specifically, by using, for example, a charging apparatus, photosensitive means corresponding to the respective colors, four developing machines supplying developers of the respective colors to the photosensitive material, and a copying machine equipped with a fixing apparatus, a photosensitive material is uniformly charged, development is conducted with a first color toner, and subsequently in the same way, sequential formation of electrostatic latent images of a second color and colors thereafter and development with color toners are repeated, and an unfixed image composed of the superposed respective color toner layers is formed on a transfer substrate. By fixing this unfixed image with a fixing apparatus, a desired polychromatic color image is formed.

EXAMPLES

The following examples illustrate in detail only the case of a magenta toner; however, the present invention is not limited to these examples, and the same applications are made also for a cyan toner, yellow toner and black toner as well.

Example 1

Binder Resin+Coloring Agent+Aromatic Hydrocarbon Copolymer Resin

<Production of polyester>

Terephthalic acid, ethylene oxide adduct of Bisphenol A, and glycerin were charged, in a ratio of 45/40/4, into a 4-necked round-bottom flask equipped with a stainless steel stirrer, glass nitrogen gas-introducing tube and falling condenser. This flask was set on a mantle heater. Next, nitrogen gas was introduced through the gas-introducing tube, and the temperature was raised while maintaining an inert gas atmosphere inside the flask. Then, 0.05 parts by weight of dibutyltin oxide was added based on 100 parts by weight of the material mixture, and the mixture was reacted for a given time period while keeping the temperature of the reaction mixture at 200° C., so that the softening point and the glass transition point of the resulting polyester resin were as shown below, to thus obtaining a polyester resin (1).

The obtained polyester resin had a softening point Tm of 110° C., a glass transition point Tg of 69° C., a number average molecular weight Mn of 4000 and a weight average molecular weight Mw of 11000. The molecular weight distribution was measured by a GPC method using tetrahydrofuran as a solvent. The glass transition point Tg was a temperature at which a peak shoulder was formed by a DSC method, and the softening point Tm was determined by a flow tester.

<Preparation of flushing coloring material>

(1) 100 parts by weight (50 parts by weight as solid component) of a pigment paste of C. I. Pigment Red 57:1 based on 100 parts by weight of the polyester resin (1) was kneaded by a kneader while heating. Phase transition of the pigment began at 90° C., and the aqueous phase and the coloring resin phase completely separated at 130° C. Water was removed from the kneader, and kneading was continued to evaporate the remaining water. After completely removing the water, the mixture was cooled to obtain a flushing magenta coloring material (1).

(2) 100 parts by weight (50 parts by weight as solid component) of a pigment paste of C. I. Pigment Red 122 based on 100 parts by weight of the polyester resin (1) was kneaded by a kneader while heating. Phase transition of the pigment began at 90° C., and the aqueous phase and the coloring resin phase completely separated at 130° C. Water was removed from the kneader, and kneading was continued to evaporate the remaining water. After completely removing the water, the mixture was cooled to obtain a flushing magenta coloring material (2).

<Preparation of aromatic hydrocarbon copolymer resin>

Isopropenyltoluene, indene, dehydrated and purified toluene, and a boron trifluoride phenolate complex (1.6-times equivalent of phenol) diluted to 10-times volume with dehydrated and purified toluene were continuously supplied to an autoclave having a net capacity of 1270 ml equipped with a stirring blade, so that the ratio by mol of isopropenyltoluene to indene was 50/50 and the total supplied amount of isopropenyltoluene and indene was 1.0 l/h. The mixture was polymerized at a reaction temperature of 5° C. Subsequently, the reaction mixture was transferred to a second-stage autoclave and the polymerization reaction was continued at 5° C. Then, when the total retention time in the first- and second-stage autoclaves reached 2 hours, the reaction mixture was discharged continuously. After a period of time three times the retention time had elapsed, the polymerization reaction was completed. After completion of the polymerization, an aqueous 1N NaOH solution was added to the reaction mixture to terminate the polymerization reaction. The resulting reaction mixture was washed with large amounts of water five times; then, the solvent and unreacted monomers were distilled off under reduced pressure by an evaporator to obtain an isopropenyltoluene/indene copolymer (1). This copolymer had a softening point Tm of 145° C., a number average molecular weight Mn of 1190, and a weight average molecular weight Mw of 2040.

<Preparation of magenta toner>

A mixture composed of 70 parts by weight of a binder resin composed of the above-described polyester resin (1), 10 parts by weight of the flushing magenta coloring material (1), 10 parts by weight of the flushing magenta coloring material (2) and 10 parts by weight of the above-described isopropenyltoluene/indene copolymer (1) was melted and kneaded by an extruder, coarsely ground by a cutter mill, and ground further by using a finely grinding machine which utilized jet streams. The resulting ground material was classified by a wind-force classifier to obtain particles having an average particle size of 7 μm. The percentage in the toner particles of dispersed copolymer resin particles having a longitudinal diameter of 2.0 μm or greater was about 8%. 100 parts by weight of these particles and 0.8 parts by weight of titanium oxide fine particles were mixed by using a Henschel mixer to obtain a magenta toner.

Example 2

Binder Resin+Coloring Agent+Aromatic Hydrocarbon Copolymer Resin

<Preparation of aromatic hydrocarbon copolymer resin>

Isopropenyltoluene, indene, dehydrated and purified toluene, and a boron trifluoride phenolate complex (1.6-times equivalent of phenol) diluted to 10-times volume with dehydrated and purified toluene were continuously supplied to an autoclave having a net capacity of 1270 ml equipped with a stirring blade, so that the ratio by mol of isopropenyltoluene to indene was 80/20 and the total supplied amount of isopropenyltoluene and indene was 1.0 l/h. The mixture was polymerized at a reaction temperature of 5° C. Subsequently, the reaction mixture was transferred to a second-stage autoclave and the polymerization reaction was continued at 5° C. Then, when the total retention time in the first- and second-stage autoclaves reached 2 hours, the reaction mixture was discharged continuously. After a period of time three times the retention time had elapsed, the polymerization reaction was completed. After completion of the polymerization, an aqueous 1N NaOH solution was added to the reaction mixture to terminate the polymerization reaction. The resulting reaction mixture was washed with large amounts of water five times; then, the solvent and unreacted monomers were distilled off under reduced pressure by an evaporator to obtain an isopropenyltoluene/indene copolymer (2). This copolymer had a softening point Tm of 90° C., a number average molecular weight Mn of 680, and a weight average molecular weight Mw of 980.

<Preparation of magenta toner>

A mixture composed of 70 parts by weight of a binder resin composed of the polyester resin (1) of Example 1, 10 parts by weight of the flushing magenta coloring material (1) and 10 parts by weight of the flushing magenta coloring material (2) used in Example 1, and 10 parts by weight of the above-described isopropenyltoluene/indene copolymer (2) was melted and kneaded by an extruder, coarsely ground by a cutter mill, and ground further by using a finely grinding machine which utilized jet streams. The resulting ground material was classified by a wind-force classifier to obtain particles having an average particle size of 7 μm. The percentage in the toner particles of dispersed copolymer resin particles having a longitudinal diameter of 2.0 μm or greater was about 8%. 100 parts by weight of these particles and 0.8 parts by weight of titanium oxide fine particles were mixed by using a Henschel mixer to obtain a magenta toner.

Example 3

Binder Resin+Coloring Agent+Aromatic Hydrocarbon Copolymer Resin

<Preparation of aromatic hydrocarbon copolymer resin>

Isopropenyltoluene, indene, dehydrated and purified toluene, and a boron trifluoride phenolate complex (1.6-times equivalent of phenol) diluted to 10-times volume with dehydrated and purified toluene were continuously supplied to an autoclave having a net capacity of 1270 ml equipped with a stirring blade, so that the ratio by mol of isopropenyltoluene to indene was 40/60 and the total supplied amount of isopropenyltoluene and indene was 1.0 l/h. The mixture was polymerized at a reaction temperature of 5° C. Subsequently, the reaction mixture was transferred to a second-stage autoclave and the polymerization reaction was continued at 5° C. Then, when the total retention time in the first- and second-stage autoclaves reached 2 hours, the reaction mixture was discharged continuously. After a period of time three times the retention time had elapsed, the polymerization reaction was completed. After completion of the polymerization, an aqueous 1N NaOH solution was added to the reaction mixture to terminate the polymerization reaction. The resulting reaction mixture was washed with large amounts of water five times; then, the solvent and unreacted monomers were distilled off under reduced pressure by an evaporator to obtain an isopropenyltoluene/indene copolymer (3). This copolymer had a softening point Tm of 170° C., a number average molecular weight Mn of 1500, and a weight average molecular weight Mw of 2700.

<Preparation of magenta toner>

A mixture composed of 70 parts by weight of a binder resin composed of the polyester resin (1) of Example 1, 10 parts by weight of the flushing magenta coloring material (1) and 10 parts by weight of the flushing magenta coloring material (2) used in Example 1, and 10 parts by weight of the above-described isopropenyltoluene/indene copolymer (3) was melted and kneaded by an extruder, coarsely ground by a cutter mill, and ground further by using a finely grinding machine which utilized jet streams. The resulting ground material was classified by a wind-force classifier to obtain particles having an average particle size of 7 μm. The percentage in the toner particles of dispersed copolymer resin particles having a longitudinal diameter of 2.0 μm or greater was about 8%. 100 parts by weight of these particles and 0.8 parts by weight of titanium oxide fine particles were mixed by using a Henschel mixer to obtain a magenta toner.

Example 4

Binder Resin+Coloring Agent+Aromatic Hydrocarbon Copolymer Resin

<Preparation of magenta toner>

A mixture composed of 75 parts by weight of a binder resin composed of the polyester resin (1) of Example 1, 10 parts by weight of the flushing magenta coloring material (1) and 10 parts by weight of the flushing magenta coloring material (2) used in Example 1, and 5 parts by weight of the isopropenyltoluene. indene copolymer (1) used in Example 1 was melted and kneaded by an extruder, coarsely ground by a cutter mill, and ground further by using a finely grinding machine utilized jet streams. The resulting ground material was classified by a wind-force classifier to obtain particles having an average particle size of 7 μm. The percentage in the toner particles of dispersed copolymer resin particles having a longitudinal diameter of 2.0 μm or greater was about 6%. 100 parts by weight of these particles and 0.8 parts by weight of titanium oxide fine particles were mixed by using a Henschel mixer to obtain a magenta toner.

Example 5

Binder Resin+Coloring Agent+Aromatic Hydrocarbon Copolymer Resin

<Preparation of magenta toner>

A mixture composed of 65 parts by weight of a binder resin composed of the polyester resin (1) of Example 1, 10 parts by weight of the flushing magenta coloring material (1) and 10 parts by weight of the flushing magenta coloring material (2) used in Example 1, and 15 parts by weight of the isopropenyltoluene. indene copolymer (1) used in Example 1 was melted and kneaded by an extruder, coarsely ground by a cutter mill, and ground further by using a finely grinding machine which utilized jet streams. The resulting ground material was classified by a wind-force classifier to obtain particles having an average particle size of 7 μm. The percentage in the toner particles of dispersed copolymer resin particles having a longitudinal diameter of 2.0 μm or greater was about 9%. 100 parts by weight of these particles and 0.8 parts by weight of titanium oxide fine particles were mixed by using a Henschel mixer to obtain a magenta toner.

Example 6

Binder Resin+Coloring Agent+Aromatic Hydrocarbon Copolymer Resin

<Preparation of aromatic hydrocarbon copolymer resin>

Isopropenyltoluene, indene, dehydrated and purified toluene, and a boron trifluoride phenolate complex (1.6-times equivalent of phenol) diluted to 10-times volume with dehydrated and purified toluene were continuously supplied to an autoclave having a net capacity of 1270 ml equipped with a stirring blade, so that the ratio by mol of isopropenyltoluene to indene was 50/50 and the total supplied amount of isopropenyltoluene and indene was 1.0 l/h. The mixture was polymerized at a reaction temperature of 5° C. Subsequently, the reaction mixture was transferred to a second-stage autoclave and the polymerization reaction was continued at 5° C. Then, when the total retention time in the first- and second-stage autoclaves reached 1.5 hours, the reaction mixture was discharged continuously. After a period of time three times of the retention time had elapsed, the polymerization reaction was completed. After completion of the polymerization, an aqueous 1N NaOH solution was added to the reaction mixture to terminate the polymerization reaction. The resulting reaction mixture was washed with large amounts of water five times; then, the solvent and unreacted monomers were distilled off under reduced pressure by an evaporator to obtain an isopropenyltoluene/indene copolymer (4). This copolymer had a softening point Tm of 95° C., a number average molecular weight Mn of 770, and a weight average molecular weight Mw of 960.

<Preparation of magenta toner>

A mixture composed of 70 parts by weight of a binder resin composed of the polyester resin (1) of Example 1, 10 parts by weight of the flushing magenta coloring material (1) and 10 parts by weight of the flushing magenta coloring material (2) used in Example 1, and 10 parts by weight of the above-described isopropenyltoluene/indene copolymer (4) was melted and kneaded by an extruder, coarsely ground by a cutter mill, and ground further by using a finely grinding machine which utilized jet streams. The resulting ground material was classified by a wind-force classifier to obtain particles having an average particle size of 7 μm. The percentage in the toner particles of dispersed copolymer resin particles having a longitudinal diameter of 2.0 μm or greater was about 7%. 100 parts by weight of these particles and 0.8 parts by weight of titanium oxide fine particles were mixed by using a Henschel mixer to obtain a magenta toner.

Example 7

Binder Resin+Coloring Agent+Aromatic Hydrocarbon Copolymer Resin

<Preparation of aromatic hydrocarbon copolymer resin>

Isopropenyltoluene, indene, dehydrated and purified toluene, and a boron trifluoride phenolate complex (1.6-times equivalent of phenol) diluted to 10-times volume with dehydrated and purified toluene were continuously supplied to an autoclave having a net capacity of 1270 ml equipped with a stirring blade, so that the ratio by mol of isopropenyltoluene to indene was 50/50 and the total supplied amount of isopropenyltoluene and indene was 1.0 l/h. The mixture was polymerized at a reaction temperature of 5° C. Subsequently, the reaction mixture was transferred to a second-stage autoclave and the polymerization reaction was continued at 5° C. Then, when the total retention time in the first- and second-stage autoclaves reached 3 hours, the reaction mixture was discharged continuously. After a period of time, reached three times the retention time had elapsed, the polymerization reaction was completed. After completion of the polymerization, an aqueous 1N NaOH solution was added to the reaction mixture to terminate the polymerization reaction. The resulting reaction mixture was washed with large amounts of water five times; then, the solvent and unreacted monomers were distilled off under reduced pressure by an evaporator to obtain an isopropenyltoluene/indene copolymer (5). This copolymer had a softening point Tm of 175° C., a number average molecular weight of 1300, and a weight average molecular weight Mw of 2350.

<Preparation of magenta toner>

A mixture composed of 70 parts by weight of a binder resin composed of the polyester resin (1) of Example 1, 10 parts by weight of the flushing magenta coloring material (1) and 10 parts by weight of the flushing magenta coloring material (2) used in Example 1, and 10 parts by weight of the above-described isopropenyltoluene/indene copolymer (5) was melted and kneaded by an extruder, coarsely ground by a cutter mill, and ground further by using a finely grinding machine which utilized jet streams. The resulting ground material was classified by a wind-force classifier to obtain particles having an average particle size of 7 μm. The percentage in the toner particles of dispersed copolymer resin particles having a longitudinal diameter of 2.0 μm or greater was about 9%. 100 parts by weight of these particles and 0.8 parts by weight of titanium oxide fine particles were mixed by using a Henschel mixer to obtain a magenta toner.

Comparative Example 1

Monomer Ratio–Changed Binder Resin+Coloring Agent

<Production of polyester>

Terephthalic acid, ethylene oxide adduct of Bisphenol A, propylene oxide adduct of Bisphenol A, and glycerin were charged, in a ratio of 45/20/20/4, into a 4-necked round-bottom flask equipped with a stainless steel stirrer, glass nitrogen gas-introducing tube and falling condenser, and this flask was set on a mantle heater. Then, nitrogen gas was introduced through the gas-introducing tube, and the temperature was raised while maintaining an inert gas atmosphere inside the flask. Then, 0.05 parts by weight of dibutyltin oxide was added based on 100 parts by weight of the material mixture, and the mixture was reacted for a given time period while keeping the temperature of the reaction mixture at 200° C., so that the softening point and the glass transition point of the resulting polyester resin were as shown below, to obtain a polyester resin (2).

The obtained polyester resin had a softening point Tm of 110° C., a glass transition point Tg of 69° C., a number average molecular weight Mn of 4200 and a weight average molecular weight Mw of 11500. The molecular weight distribution was measured by a GPC method using tetrahydrofuran as a solvent. The glass transition point Tg was a temperature at which a peak shoulder was formed by a DSC method, and the softening point Tm was determined by a flow tester.

<Preparation of flushing coloring material>

(1) 100 parts by weight (50 parts by weight as solid component) of a pigment paste of C. I. Pigment Red 57:1 based on 100 parts by weight of the polyester resin (2) was kneaded by a kneader while heating. Phase transition of the pigment began at 90° C., and the aqueous phase and the coloring resin phase completely separated at 130° C. Water was removed from the kneader, and kneading was continued to evaporate the remaining water. After complete removal of the water, the mixture was cooled to obtain a flushing magenta coloring material (3).

(2) 100 parts by weight (50 parts by weight as solid component) of a pigment paste of C. I. Pigment Red 122 based on 100 parts by weight of the polyester resin (2) was kneaded by a kneader while heating. Phase transition of the pigment initiated at 90° C., and the aqueous phase and the coloring resin phase completely separated at 130° C. Water was removed from the kneader, and kneading was further continued to evaporate the remaining water. After complete removal of the water, the mixture was cooled to obtain a flushing magenta coloring material (4).

<Preparation of magenta toner>

A mixture composed of 80 parts by weight of a binder resin composed of the above-described polyester resin (2) , 10 parts by weight of the flushing magenta coloring material (3), and 10 parts by weight of the flushing magenta coloring material (4) was melted and kneaded by an extruder, coarsely ground by a cutter mill, and ground further by using a finely grinding machine which utilized jet streams. The resulting ground material was classified by a wind-force classifier to obtain particles having an average particle size of 7 $\mu$m. 100 parts by weight of these particles and 0.8 parts by weight of titanium oxide fine particles were mixed by using a Henschel mixer to obtain a magenta toner.

Comparative Example 2

Softening Point–Reducing Binder Resin+Coloring Agent

<Production of polyester>

Terephthalic acid, ethylene oxide adduct of Bisphenol A, and glycerin were charged, in a ratio of 45/40/4, into a 4-necked round-bottom flask equipped with a stainless steel stirrer, glass nitrogen gas-introducing tube and falling condenser. This flask was set on a mantle heater. Then, nitrogen gas was introduced through the gas-introducing tube, and the temperature was raised while maintaining an inert gas atmosphere inside the flask. Then, 0.05 parts by weight of dibutyltin oxide was added based on 100 parts by weight of the material mixture, and the mixture was reacted for a given time period while keeping the temperature of the reaction mixture at 200° C., so that the softening point and the glass transition point of the resulting polyester resin were as shown below, to obtain a polyester resin (3).

The obtained polyester resin had a softening point Tm of 105° C., a glass transition point Tg of 66° C., a number average molecular weight Mn of 4450 and a weight average molecular weight Mw of 8700. The molecular weight distribution was measured by a GPC method using tetrahydrofuran as a solvent. The glass transition point Tg was a temperature at which a peak shoulder was formed by a DSC method, and the softening point Tm was determined by a flow tester.

<Preparation of flushing coloring material>

(1) 100 parts by weight (50 parts by weight as solid component) of a pigment paste of C. I. Pigment Red 57:1 based on 100 parts by weight of the polyester resin (3) was kneaded by a kneader while heating. Phase transition of the pigment began at 90° C., and the aqueous phase and the coloring resin phase completely separated at 130° C. Water was removed from the kneader, and kneading was further continued to evaporate the remaining water. After complete removal of the water, the mixture was cooled to obtain a flushing magenta coloring material (5).

(2) 100 parts by weight (50 parts by weight as solid component) of a pigment paste of C. I. Pigment Red 122 based on 100 parts by weight of the polyester resin (3) was kneaded by a kneader while heating. Phase transition of the pigment began at 90° C., and the aqueous phase and the coloring resin phase completely separated at 130° C. Water was removed from the kneader, and kneading was further continued to evaporate the remaining water. After complete removal of the water, the mixture was cooled to obtain a flushing magenta coloring material (6).

<Preparation of magenta toner>

A mixture composed of 80 parts by weight of a binder resin composed of the above-described polyester resin (3), 10 parts by weight of the above-described flushing magenta coloring material (5), and 10 parts by weight of the flushing magenta coloring material (6) was melted and kneaded by an extruder, coarsely ground by a cutter mill, and ground further by using a finely grinding machine which utilized jet streams. The resulting ground material was classified by a wind-force classifier to obtain particles having an average particle size of 7 $\mu$m. 100 parts by weight of these particles and 0.8 parts by weight of titanium oxide fine particles were mixed by using a Henschel mixer to obtain a magenta toner.

Comparative Example 3

Softening Point Raising Binder Resin+Coloring Agent

<Production of polyester>

Terephthalic acid, ethylene oxide adduct of Bisphenol A, and glycerin were charged, in a ratio of 45/40/4, into a 4-necked round-bottom flask equipped with a stainless steel stirrer, glass nitrogen gas-introducing tube and falling condenser. This flask was set on a mantle heater. Then, nitrogen gas was introduced through the gas introducing tube, and the temperature was raised while maintaining an inert gas atmosphere inside the flask. Then, 0.05 parts by weight of dibutyltin oxide was added based on 100 parts by weight of the material mixture, and the mixture was reacted for a given time period, while keeping the temperature of the reaction mixture at 200° C., so that the softening point and the glass transition point of the resulting polyester resin were as shown below, to obtain a polyester resin (4).

The obtained polyester resin had a softening point Tm of 115° C., a glass transition point Tg of 72° C., a number average molecular weight Mn of 5200 and a weight average molecular weight Mw of 21000. The molecular weight distribution was measured by a GPC method using as a solvent tetrahydrofuran as a solvent. The glass transition point Tg was a temperature at which a peak shoulder was formed by a DSC method, and the softening point Tm was determined by a flow tester.

<Preparation of flushing coloring material>

(1) 100 parts by weight (50 parts by weight as solid component) of a pigment paste of C. I. Pigment Red 57:1 based on 100 parts by weight of the polyester resin (4) was kneaded by a kneader while heating. Phase transition of the pigment began at 90° C., and the aqueous phase and the coloring resin phase completely separated at 130° C. Water was removed from the kneader, and kneading was continued to evaporate the remaining water. After completely removing the water, the mixture was cooled to obtain a flushing magenta coloring material (7).

(2) 100 parts by weight (50 parts by weight as solid component) of a pigment paste of C. I. Pigment Red 122 based on 100 parts by weight of the polyester resin (4) was kneaded by a kneader while heating. Phase transition of the pigment began at 90° C., and the aqueous phase and the coloring resin phase completely separated at 130° C. Water was removed from the kneader, and kneading was continued to evaporate the remaining water. After completely removing the water, the mixture was cooled to obtain a flushing magenta coloring material (8).

<Preparation of magenta toner>

A mixture composed of 80 parts by weight of a binder resin composed of the above-described polyester resin (4) , 10 parts by weight of the flushing magenta coloring material (7) and 10 parts by weight of the flushing magenta coloring material (8) was melted and kneaded by an extruder, coarsely ground by a cutter mill, and ground further by using a finely grinding machine which utilized jet streams. The resulting ground material was classified by a wind-force classifier to obtain particles having an average particle size of 7 $\mu$m. 100 parts by weight of these particles and 0.8 parts by weight of titanium oxide fine particles were mixed by using a Henschel mixer to obtain a magenta toner.

Comparative Example 4

Binder Resin+Coloring Agent+Aliphatic Hydrocarbon-Aromatic Hydrocarbon Copolymer Resin <Preparation of aliphatic hydrocarbon-aromatic hydrocarbon copolymer resin>

90 g of isopropenyltoluene, 10 g of C5 fraction (n-pentane/isoprene/1,3-pentadiene/cyclopentadiene=5/6/3/3) obtained by thermal cracking of petroleum naphtha, and 150 g of toluene were charged into an autoclave, and the mixture was reacted by adding in drops, as a catalyst, 1.5 g of BF3 phenol complex over a period of about 10 minutes, keeping the temperature at 0° C. while stirring. Then, the stirring was continued for another 3 hours. Then, 50 ml of a 5 wt % aqueous sodium hydroxide solution was added, and after the mixture was vigorously stirred for 30 minutes to decompose the catalyst, the aqueous phase was separated and polymer oil was obtained. Further, after the polymer oil was washed with water until it became neutral, and the unreacted oil and solvent were distilled off under reduced pressure with heating to obtain a hydrocarbon resin in the form of a white lump. This resin had a softening point Tm of 125° C., a number average molecular weight of 1150, and a weight average molecular weight Mw of 1950.

<Preparation of magenta toner>

A mixture composed of 70 parts by weight of a binder resin composed of the above-described polyester resin (1) of Example 1, 10 parts by weight of the flushing magenta coloring material (1) and 10 parts by weight of the flushing magenta coloring material (2) used in Example 1 and 10 parts by weight of the above-described aliphatic hydrocarbon-aromatic hydrocarbon copolymer resin was melted and kneaded by an extruder, coarsely ground by a cutter mill, and ground further by using a finely grinding machine which utilized jet streams. The resulting ground material was classified by a wind-force classifier to obtain particles having an average particle size of 7 $\mu$m. The percentage in the toner particles of dispersed copolymer resin particles having a longitudinal diameter of 2.0 $\mu$m or greater was about 6%. 100 parts by weight of these particles and 0.8 parts by weight of titanium oxide fine particles were mixed by using a Henschel mixer to obtain a magenta toner.

Comparative Example 5

Binder Resin+Coloring Agent+Aliphatic Hydrocarbon-Aromatic Hydrocarbon Copolymer Resin <Preparation of aliphatic hydrocarbon-aromatic hydrocarbon copolymer resin>

A copolymer resin composed of isopropenyltoluene, $\alpha$-methylstyrene, and C5 fraction (n-pentane/isoprene/1,3-pentadiene/cyclopentadiene=5/6/3/3) in a ratio by mol of 45/45/10 was obtained in the same manner as described in (Comparative Example 4). This resin had a softening point Tm of 125° C., a number average molecular weight Mn of 1290, and a weight average molecular weight Mw of 2140. <Preparation of magenta toner>was the same as described in (Comparative Example 4).

Comparative Example 6

Binder Resin+Coloring Agent+Aromatic Hydrocarbon Homopolymer Petroleum Resin <Preparation of aromatic hydrocarbon homopolymer petroleum resin>

Isopropenyltoluene, dehydrated and purified toluene, and a boron trifluoride phenolate complex (1.6-fold equivalent of phenol) diluted to 10-times volume with dehydrated and purified toluene were continuously supplied to an autoclave having a net capacity of 1270 ml equipped with a stirring blade, so that the supplied amount of isopropenyltoluene was 1.0 l/h. The mixture was polymerized at a reaction temperature of 5° C. Subsequently, the reaction mixture was transferred to a second-stage autoclave and the polymerization reaction was continued at 5° C. Then, when the total retention time in the first- and second-stage autoclaves reached 2 hours, the reaction mixture was discharged continuously. After a period of time three times the retention time had elapsed, the polymerization reaction was completed. After completion of the polymerization, an aqueous 1N NaOH solution was added to the reaction mixture to terminate the polymerization reaction. The resulting reaction mixture was washed with large amounts of water five times; then, the solvent and unreacted monomers were distilled off under reduced pressure by an evaporator to obtain an isopropenyltoluene homopolymer resin. This copolymer had a softening point Tm of 120° C., a number average molecular weight Mn of 920, and a weight average molecular weight Mw of 1420.

<Preparation of magenta toner>

A mixture composed of 70 parts by weight of a binder resin composed of the polyester resin (1) of Example 1, 10 parts by weight of the flushing magenta coloring material (1) and 10 parts by weight of the flushing magenta coloring material (2) used in Example 1, and 10 parts by weight of the above-described aromatic hydrocarbon homopolymer petroleum resin was melted and kneaded by an extruder, coarsely ground by a cutter mill, and ground further by using a finely grinding machine which utilized jet streams. The resulting ground material was classified by a wind-force classifier to obtain a particles having an average particle size of 7 μm. The percentage in the toner particles of dispersed copolymer resin particles having a longitudinal diameter of 2.0 μm or greater was about 6%. 100 parts by weight of these particles and 0.8 parts by weight of titanium oxide fine particles were mixed by using a Henschel mixer to obtain a magenta toner.

<Evaluation>

Grindability, melting and adhering in apparatuses, charging property, fixing property, and OHP transparency were evaluated based on the following criteria. The results are shown in Table 1. An overall evaluation is also shown in Table 1.

(1) Grindability

The magenta toners were ground to obtain the same particle size by using a grinding machine which utilized jet streams, and when this particle size was obtained in a stable manner, the supplied amounts of the coarsely ground materials per unit time were compared.

| | | | |
|---|---|---|---|
| ⊙: 50 kg/h or more | ○: 40 kg/h or more | Δ: 30 kg/h or more | x: less than 30 kg/h |

(2) Melting and adhering in apparatuses

The same amounts of magenta toners were classified, and the weights of the toners melted and adhered to producing parts of the classification apparatuses were compared.

| | | |
|---|---|---|
| ○: 50 mg or less | Δ: 50 mg or more | x: 100 mg or more |

(3) Charging property

An iron powder having an average particle size of 50 μm coated with a fluorine-containing acrylic resin was used as a carrier and mixed with each of the above-described toner compositions so that the toner concentrations were respectively 8% by weight, to prepare developers. After 50,000 pieces of paper were copied by a copying machine (A-Color 935, manufactured by Fuji Xerox Corp.) using the developer, the reductions in charge of the developers were compared.

The ratio of the charge of the developer after 50,000 pieces of paper were copied to the initial charge was classified in the following way.

| | | |
|---|---|---|
| ○: 0.8 or more | Δ: 0.7 or more | x: less than 0.7 |

(4) Fixing property

For each of the above-described developers, an image was produced by a copying machine (A-Color 935, manufactured by Fuji Xerox Corp.) using the above-described developer, to obtain a unfixed image. Then, an evaluation was conducted by using an external fixing machine comprising a heat roller whose surface was made from silicon rubber. A magenta solid image of 25 mm×25 mm was fixed at 160° C., and was folded by using a weight of constant load. The extent of defects in the image in the folded part was qualitatively evaluated.

| | | |
|---|---|---|
| ○: no image defects at all | Δ: streak traces remain in the folded part | x: image defects are recognized in the folding part, and the underlying material was visible. |

(5) OHP transparency

An unfixed solid image of 4 cm×5 cm was formed on an OHP sheet, and after fixing at 160° C., an evaluation was conducted by the naked eye, with transparency classified into the following grades.

| | | |
|---|---|---|
| ○: transparency is excellent | Δ: transparency is partially poor | x: transparency is poor, and the OHP projected image looked totally opaque |

(6) Total evaluation

| | |
|---|---|
| ○: excellent | Δ: usable |
| x: can not be used | |

TABLE 1

| | (1) Grindability | (2) Melting and adhering in apparatuses | (3) Charging property | (4) Fixing property | (5) OHP transparency | (6) Overall evaluation |
|---|---|---|---|---|---|---|
| Example 1 | ○ | ○ | ○ | ○ | ○ | ○ |
| Example 2 | ○ | ○ | ○ | ○ | ○ | ○ |
| Example 3 | ○ | ○ | ○ | ○ | ○ | ○ |
| Example 4 | Δ | ○ | ○ | ○ | ○ | Δ |
| Example 5 | ⊙ | ○ | ○ | ○ | ○ | ○ |
| Example 6 | ○ | ○ | Δ | Δ | ○ | Δ |
| Example 7 | ○ | ○ | Δ | Δ | ○ | Δ |
| Comparative Example 1 | ○ | X | ○ | ○ | ○ | X |
| Comparative Example 2 | ⊙ | X | ○ | X | ○ | X |
| Comparative Example 3 | X | ○ | ○ | X | ○ | X |
| Comparative Example 4 | ○ | ○ | X | ○ | ○ | X |
| Comparative Example 5 | ○ | ○ | X | ○ | ○ | X |
| Comparative Example 6 | ○ | ○ | X | ○ | ○ | X |

The electrostatic charge image developing toner of the present invention has excellent grindability in a finely grinding process, can prevent melting and adhering in production apparatuses and in tubes connecting them, and can provide an excellent fixing property. Further, the electrostatic charge image developing toner of the present invention does not shorten life of a developer as occurs when adding an additive due to the reduction in the charging property, does not cause deterioration in the fixing property at low temperatures, and further can form a color fixed image which provides excellent OHP projected image transparency.

We claim:

1. An electrostatic charge image developing toner comprising at least a binder resin, a coloring agent, and an aromatic hydrocarbon copolymer resin, wherein, in a toner particle, the percentage of dispersed aromatic hydrocarbon copolymer resin particles having a longitudinal diameter of 2.0 μm or greater among the total number of dispersed aromatic hydrocarbon copolymer is 10% or less, and wherein the copolymer resin contains at least a styrene-based monomer and an indene-based monomer.

2. An electrostatic charge image developing toner according to claim 1, wherein the softening point Tm of the copolymer resin is from 100 to 170° C.

3. An electrostatic charge image developing toner according to claim 1, wherein the styrene-based monomer in the copolymer resin is at least one monomer selected from the group consisting of vinyltoluene, α-methylstyrene and isopropenyltouene, and the indene-based monomer is indene.

4. An electrostatic charge image developing toner according to claim 1, wherein the ratio by mol of the styrene-based monomer to the indene-based monomer in the copolymer resin is from 40/60 to 80/20.

5. An electrostatic charge image developing toner according to claim 1, wherein the glass transition point of the binder resin is from 60 to 75° C.

6. An electrostatic charge image developing toner according to claim 1, wherein the copolymer resin is contained in an amount from 1 to 20 parts by weight based on 100 parts by weight of the binder resin.

7. An electrostatic charge image developing toner according to claim 1, wherein the binder resin is a polyester resin.

8. An electrostatic charge image developing toner according to claim 7, wherein the weight average molecular weight of the polyester resin is from 7000 to 30000.

9. An electrostatic charge image developing toner according to claim 1, wherein the coloring agent is selected from the group consisting of C. I. Pigment Red 57:1 and/or C. I. Pigment Red 122, C. I. Pigment Yellow 180, C. I. Pigment Blue 15:3 and carbon black.

10. An electrostatic charge image developer comprising at least a toner and a carrier, wherein the electrostatic charge image developing toner of claim 1 is used as said toner.

11. An electrostatic charge image developer according to claim 10, wherein the carrier has a resin coating layer.

12. An image forming method comprising at least a process for forming an electrostatic latent image on an electrostatic charge image substrate and a process for developing said electrostatic latent image by using a developer layer on a developer support, wherein an electrostatic charge image developer in the developer layer comprises at least a carrier and an electrostatic charge image developing toner comprising at least a binder resin, a coloring agent, and an aromatic hydrocarbon copolymer resin which contains at least a styrene-based monomer and an indene-based monomer and which is dispersed so that, in a toner particle, the percentage of dispersed aromatic hydrocarbon copolymer resin particles having a longitudinal diameter of 2.0 μm or greater among the total number of dispersed aromatic hydrocarbon copolymer resin particles is 10% or less.

13. An image forming method according to claim 12, wherein a polychromatic image is formed by using an electrostatic charge image developer including a magenta toner comprising at least a binder resin, a copolymer resin containing a styrene-based monomer and indene-based monomer, and C. I. Pigment Red 57:1 and/or C. I. Pigment Red 122; a yellow toner comprising at least a binder resin, a copolymer resin containing a styrene-based monomer and indene-based monomer, and C. I. Pigment Yellow 180; and a cyan toner comprising at least a binder resin, a copolymer resin containing a styrene-based monomer and indene-based monomer, and C. I. Pigment Bleu 15:3.

14. An image forming method according to claim 13, wherein the electrostatic charge image developer further includes a black toner comprising at least a binder resin, copolymer resin containing a styrene-based monomer and indene-based monomer, and carbon black.

15. An image forming method according to claim 12, wherein the softening point Tm of the copolymer resin is from 100 to 170° C.

16. An image forming method according to claim 12, wherein the styrene-based monomer in the copolymer resin is at least one monomer selected from the group consisting of vinyltoluene, α-methylstyrene and isopropenyltoluene, and the indene-based monomer is indene.

17. An image forming method according to claim 12, wherein the ratio by mol of the styrene-based monomer to the indene-based monomer in the copolymer resin is from 40/60 to 80/20.

18. An image forming method according to claim 12, wherein the glass transition point of the binder resin is from 60 to 75° C.

19. An image forming method according to claim 12, wherein the copolymer resin is contained in an amount of from 1 to 20 parts by weight based on 100 parts by weight of the binder resin.

20. An electrostatic charge image developing toner comprising at least a binder resin, a coloring agent, and an aromatic hydrocarbon copolymer resin, wherein, in a toner particle, the percentage of dispersed aromatic hydrocarbon copolymer resin particles having a longitudinal diameter of 2.0 μm or greater among the total number of dispersed aromatic hydrocarbon copolymer is 10% or less, and wherein the hydrocarbon copolymer resin contains at least an indene monomer and a styrene-based monomer which is at least one monomer selected from the group consisting of vinyltoluene, α-methylstyrene and isopropenyltoluene.

* * * * *